US005103900A

United States Patent [19]

McLeod et al.

[11] Patent Number: 5,103,900

[45] Date of Patent: Apr. 14, 1992

[54] HIGH PRESSURE ADAPTER FOR WELL-HEADS

[76] Inventors: Roderick D. McLeod, 5104-125 Street, Edmonton, Alberta, Canada, T6H 3V5; Albert Roesch, 28 Parsons Close, Red Deer, Alberta, Canada

[21] Appl. No.: 589,035

[22] Filed: Sep. 27, 1990

[30] Foreign Application Priority Data

Sep. 28, 1989 [CA] Canada ..... 614243

[51] Int. Cl.[5] ..... E21B 33/03

[52] U.S. Cl. ..... 166/88; 166/89

[58] Field of Search ..... 166/75.1, 86, 88, 89

[56] References Cited

U.S. PATENT DOCUMENTS 2,652,895 9/1953 Arrowood ..... 166/89

2,771,956 11/1956 Johnson ..... 166/88

3,354,962 11/1967 Pierce, Jr. ..... 166/89

3,478,822 11/1969 Holbert, Jr. et al. ..... 166/88

*Primary Examiner*—Thuy M. Bui

*Attorney, Agent, or Firm*—Anthony R. Lambert

[57] ABSTRACT

A novel adapter and pin assembly allows the close attachment of a high pressure pumping array of valves to the low pressure tubing or casing head on the well. This allows high pressure fluids or gases to be pumped through the low pressure tubing or casing head, into the tubing and down the well while isolating the low pressure tubing or casing head from these fluids or gases. The high pressure seals are tested prior to the start of the high pressure pumping, and the low pressure fittings are protected and monitored by suitable vents.

10 Claims, 6 Drawing Sheets

HIGH PRESSURE ADAPTER FOR WELL-HEADS

FIELD OF THE INVENTION

This invention relates to oil and gas well servicing and specifically to tubing head adapters as utilized during the oilfield well stimulation procedures of acidizing and fracturing.

BACKGROUND OF THE INVENTION

Many of the procedures of oilfield well servicing require that fluids and gases mixed with various chemicals and propants be pumped down the well tubing or casing under high pressures in the operations called acidizing and fracturing. This discussion will assume that a fluid is being pumped, and that the operation is that of acidizing. The wellhead fittings (spools, casing heads, tubing heads, valves, etc.) are normally rated for the pressure at which the well will be producing fluid while the pressures required for acidizing are several magnitudes higher than the producing pressure. It is thus required that some method of isolating the low pressure fittings from the high pressure fluid be used. Wells which are under pressure before the servicing is attempted are handled using a Well Tree Saver, Canada Pat. No. 1,094,945 or my invention, the Wellhead Isolation Tool, Canada Pat. No. 1,217,128, or some like apparatus. In the case of wells which are not under pressure and can have the array of wellhead valves and spools taken off prior to servicing, a different method of protecting the remaining low pressure fittings is utilized.

An example of the existing art is shown by the McEvoy PST adapter and packoff nipple shown in full section in FIG. 1 and, with a suggested but unreliable modification, in FIG. 2. It will be noted that there are a multitude of different wellhead arrangements where this adapter could be used which would include casing hangers along with the tubing hanger, but for this discussion, we will be limited to the simple casing head and tubing hanger.

Referring to FIG. 1, the casing head 1, is attached at its lower end to the casing 2, and holds in a cone shaped section, the tubing hanger 5, which holds the well tubing 3, in its lower end. The tubing head adapter 6, is attached to the casing head and has fitted and sealed inside it the packoff nipple 7, with its packing rings 8, the lower end of this packoff nipple being threaded into the tubing hanger. A cavity 10, is evident in the assembly. A high pressure valve 9, (or array of valves), completes the system. As can be seen, fluid passing through the open high pressure valve will pass through the packoff nipple, the tubing hanger and down the tubing. These are all high pressure rated fittings. The various seals and threaded fittings keep the high pressure fluid from contacting the casing head in the cavity 10. For this example, the casing head will be rated at 2000 psi. Under the new American Petroleum Institute (API) regulations, the tubing head adapter would be rated at 2000 psi at its lower end and 3000 psi at its upper end. (The regulations state that adapters are only allowed to raise the pressure rating by one rating division per adapter. The rating divisions are 2000 psi, 3000 psi, 5000 psi, 10000 psi, 15000 psi and 20000 psi.)

In order to obtain a higher pressure rating with this system, an assembly as shown in FIG. 2 would be required. The changeover spool 11, has been added, and the packoff nipple made longer to accommodate the added length. The cavity 10, is also larger. This assembly will allow a pressure of 5000 psi to be pumped through the array. To go up another pressure rating and pump at 10000 psi, another changeover spool would have to be added and the packoff nipple made longer. The disadvantages and objections to this type of stacking are:

a) Leakage past the seals on the packoff nipple will pressurize the cavity and damage the casing head.
b) The height above the casing head of the high pressure valve causes problems in assembly and operation.
c) The number of joints make leakage a distinct possibility.
d) The time required to set up this array is expensive.

SUMMARY OF THE INVENTION

The present invention provides a unique method for allowing the tubing head adapter and packoff nipple assembly to jump several pressure ratings in a short spacing and thus overcome the disadvantages and objections to the existing art. This invention also increases the safety aspect of using these adapters and allows monitoring and venting of the low pressure wellhead equipment during treatment practices.

According to a broad aspect, the invention relates to a tubing head adapter and packoff nipple assembly which has a venting valve which allows the cavity formed in the tubing head adapter to be vented to atmosphere and thus the flange joint between the tubing head adapter and the casing head becomes a non-pressure joint. The API ratings will no longer apply. The packing for the packoff nipple is enclosed in the tubing head adapter instead of being exposed on the packoff nipple and will be less likely to be damaged on assembly. A pressure testing port between these internal packing rings allows the seals to be tested after the unit is assembled and before actual treating fluid pressure is applied. A second embodiment of the invention is presented which will allow the adaptation of the assembly to the several pressure ranges of casing heads.

Thus in one embodiment of the invention there is provided a high pressure adapter for a wellhead for use with a high pressure valve, the high pressure valve having a bore, and in which the wellhead includes a casing head, tubing and casing, the casing being suspended from the casing head and the tubing being disposed within the casing to form an annulus between the casing and the tubing, the high pressure adapter comprising: hanger means for suspending the tubing within the casing; a tubing head adapter disposed between the casing head and the high pressure valve, and defining a cavity the tubing having a portion extending into the cavity; sealing means disposed against the tubing above and below the cavity for sealing the bore of the high pressure valve from the cavity and for sealing the cavity from the annulus between the casing and the tubing; and venting means for venting the cavity to atmospheric pressure.

The venting means may be a port in the tubing head adapter for venting the cavity, and the hanger means may include a tubing hanger supported by the casing head, and the sealing means may include a packoff nipple connected to the tubing hanger, the packoff nipple being disposed within and sealed against the tubing head adapter. If a cross-over spool is used, the venting means may be a port in the crossover spool.

Also, the adapter flange may include the hanger means, and the sealing means may include a wrap-around dognut supported by the casing head and sealed against the casing. A port may be used to vent the annulus.

In addition, the tubing head adapter may be a cross-over spool disposed between the casing head and the adapter flange.

BRIEF DESCRIPTION OF THE DRAWINGS

The invention is illustrated by way of example only in the accompanying drawings in which like numerals denote like elements and in which.

DESCRIPTION OF PREFERRED EMBODIMENTS

Figure 1:
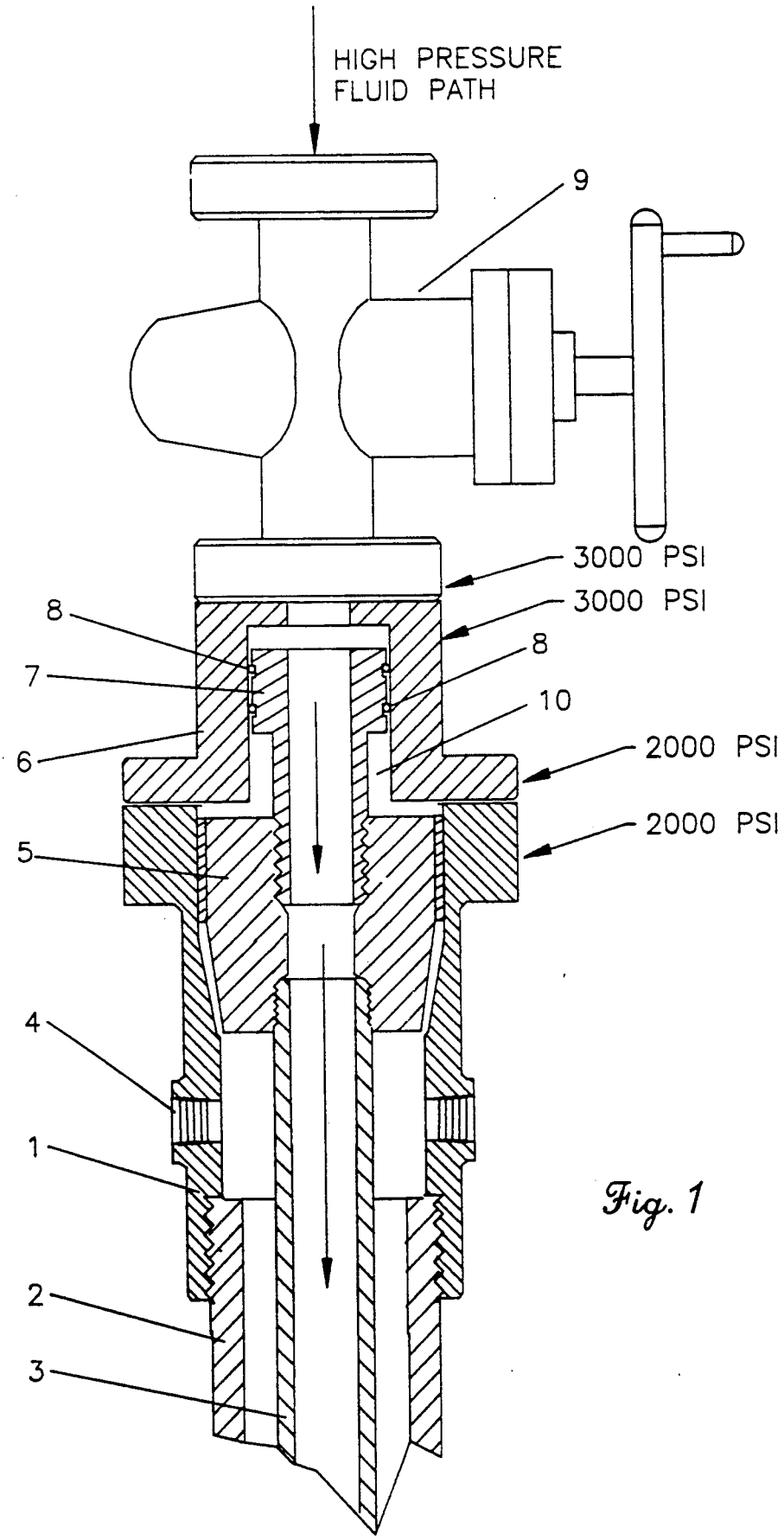
FIG. 1 is a section of a prior art adapter.
Figure 2:
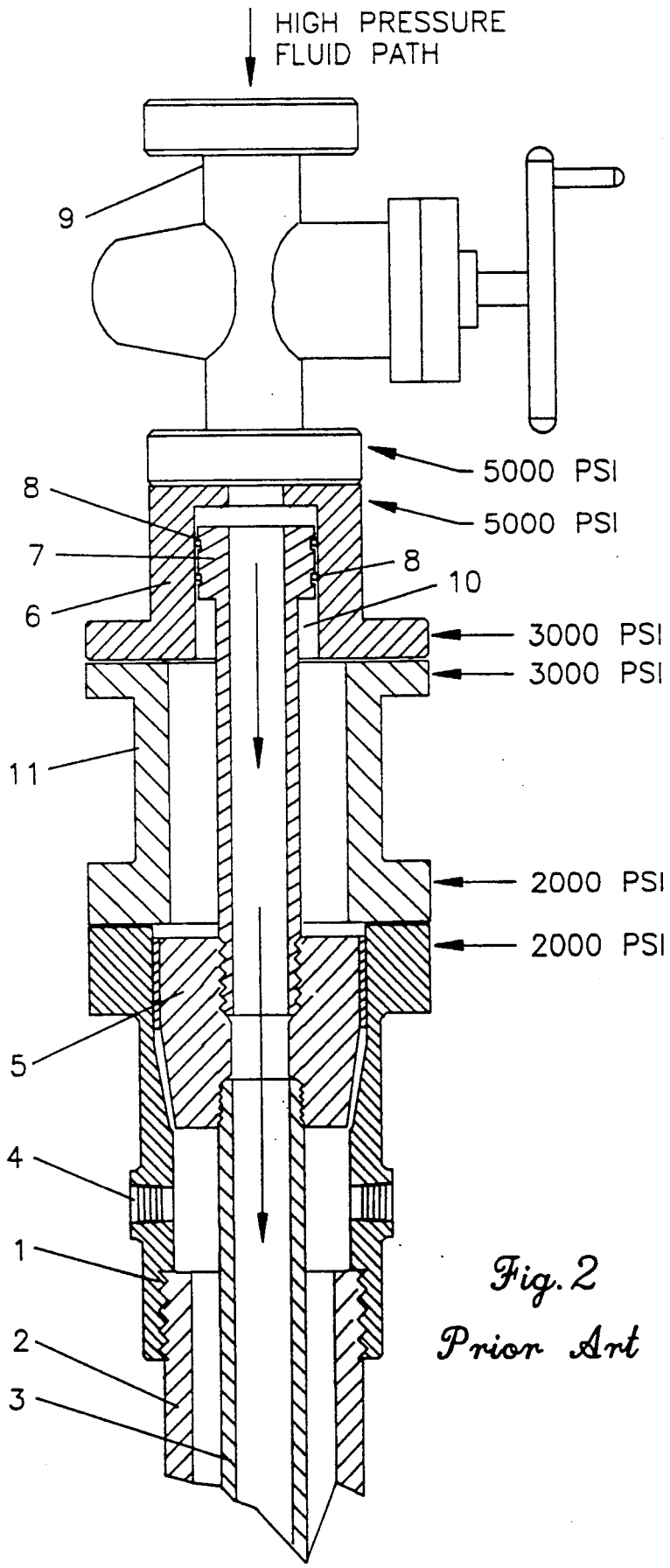
Fig. 2 Prior Art
FIG. 2 is a section of a prior art adapter with a suggested, but unreliable, modification.

FIGS. 1 and 2 have been described in the section of this patent disclosure entitled Background of the Invention, and need not be described further here.

Figure 3:
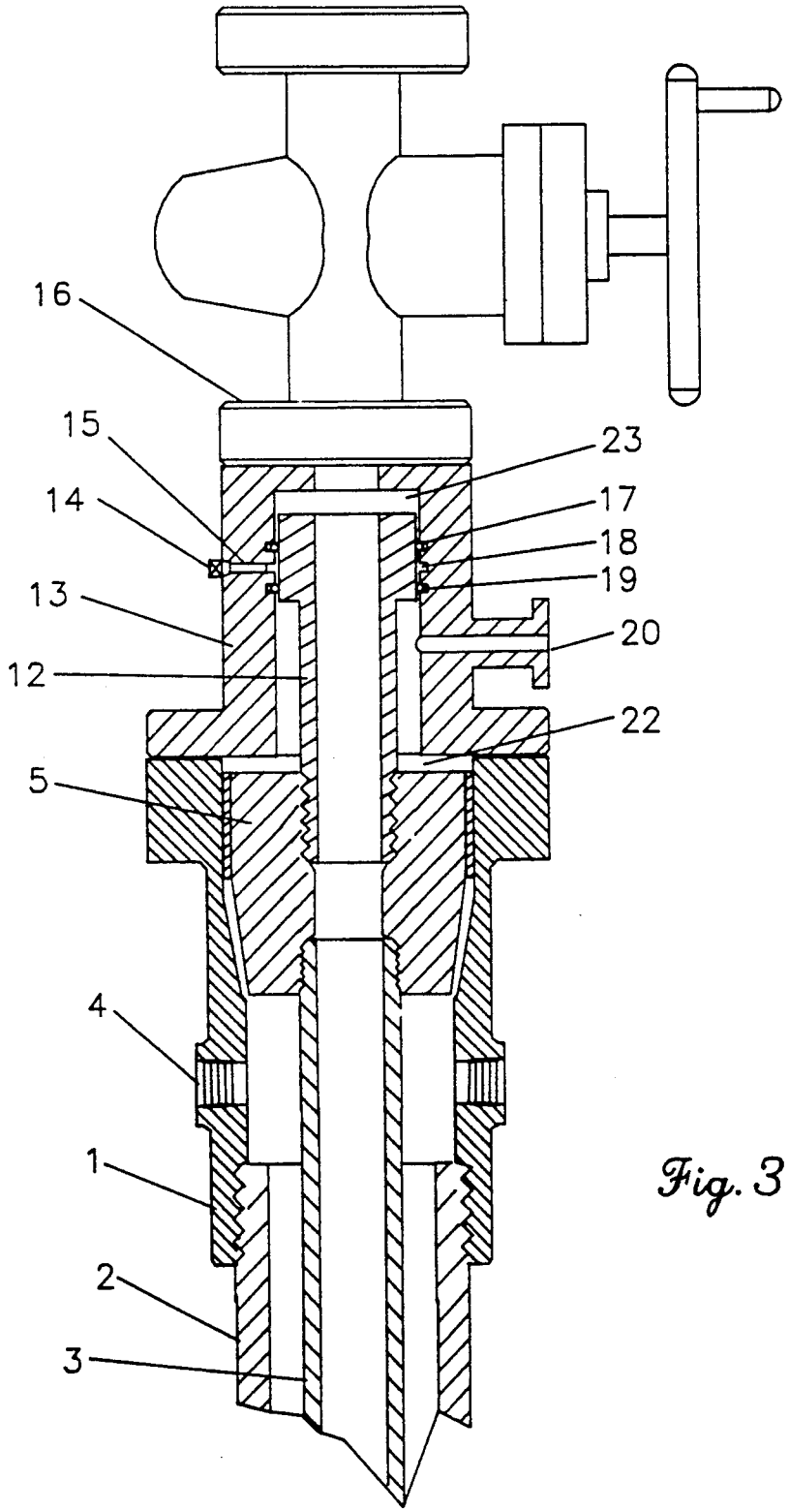
FIG. 3 is a cross sectional schematic view of the invention installed on a casing head.

Referring to FIG. 3, the assembly illustrated generally comprises of a tubing head adapter 13, attached to the casing head with its attached casing 2 plug 4, enclosed and restrained tubing hanger 5, and the tubing 3, threaded into this hanger. The packoff nipple 12, an extension of the tubing 3, has been threaded into the top of the tubing hanger. The internal bore 23, of the tubing head adapter has internal packing ring grooves at 17 and 19, and between them a test pressure groove 18, which is ported at 15 to the test fitting 14. Below the packing groove 19, is the vent port 20, which insures that the cavity 22, is vented to atmosphere and does not allow pressure to act on the casing head. The top of the tubing head adapter terminates in the attachment for the high pressure valve 16. The casing head with a rating of 2000 psi may now be adapted to a valve with a rating of 10000 psi with this single step.

Prior to the treating fluid pumping operation, fluid is pumped into the test fitting at 14, through the port 15 and into the annular space created by the groove 18 between the packing rings in the grooves 17 and 19 and the packoff nipple. The pressure in this space is raised to a value above that which the packing will see during the high pressure pumping operation. Any leakage will be noted at the outlet of the high pressure valve 16, or at the vent 20. The assembly is now ready to be used.

It will also be noted at this point that the depth of the internal bore of the tubing head adapter and the length of the packoff nipple are designed so as to take into account the differences in height of the many tubing hangers found in the oilfield. The number of packing rings in the tubing head adapter is usually more than two, and test ports are set between them.

DESCRIPTION OF THE SECOND EMBODIMENT

Figure 4:
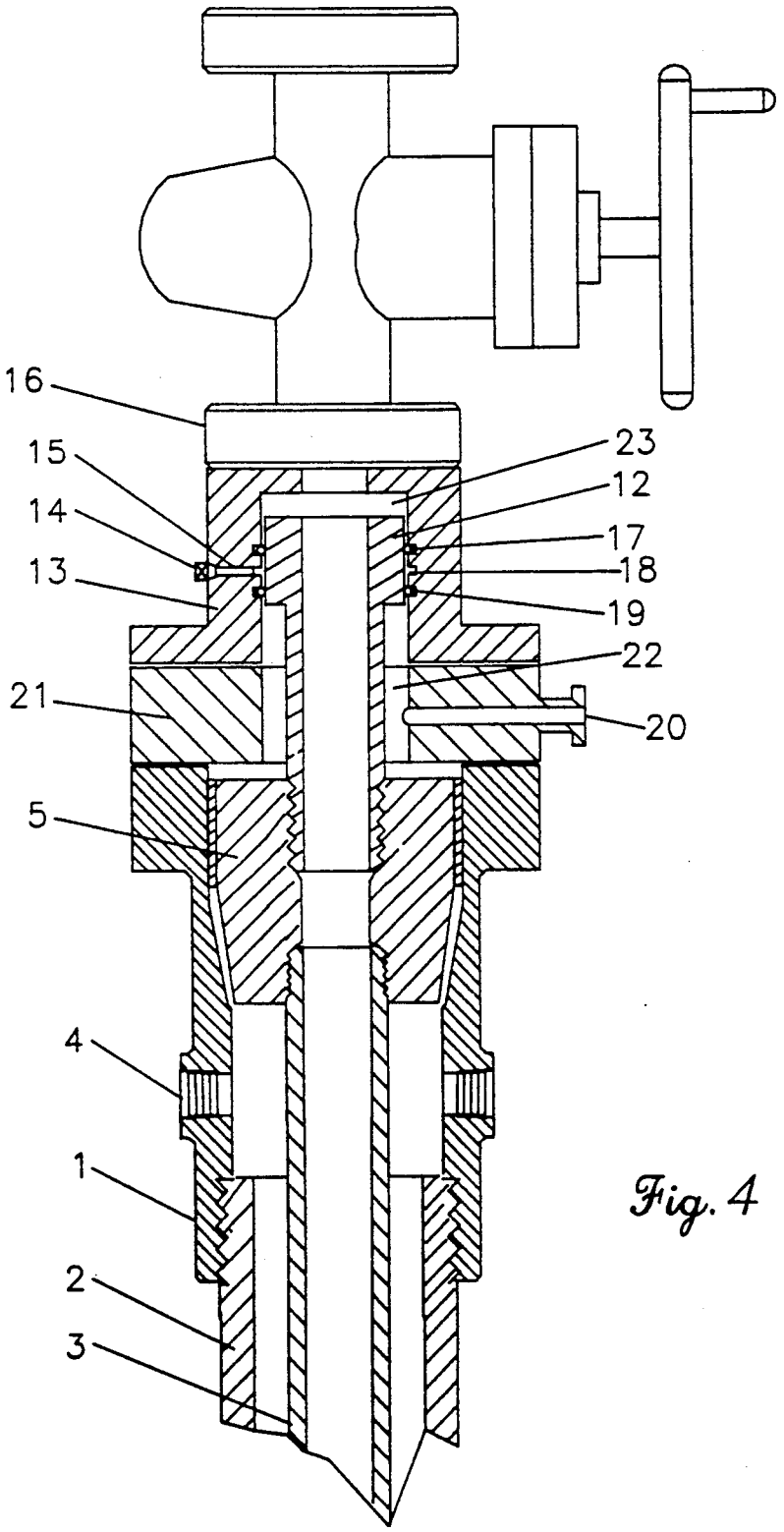
FIG. 4 is a cross sectional schematic view of the second embodiment of the invention installed on a casing head.

Referring to FIG. 4, the assembly shown is generally the same as that described in FIG. 3. The vent port 20, however, has been moved to the added adapter flange 21. This will allow casing heads in the other ranges of 3000 psi and 5000 psi to be quickly adapted to the tubing head adapter and thus to the 10000 psi or 15000 psi high pressure valve at the top.

The invention is further illustrated by reference to FIG. 5 and FIG. 6.

Figure 5:
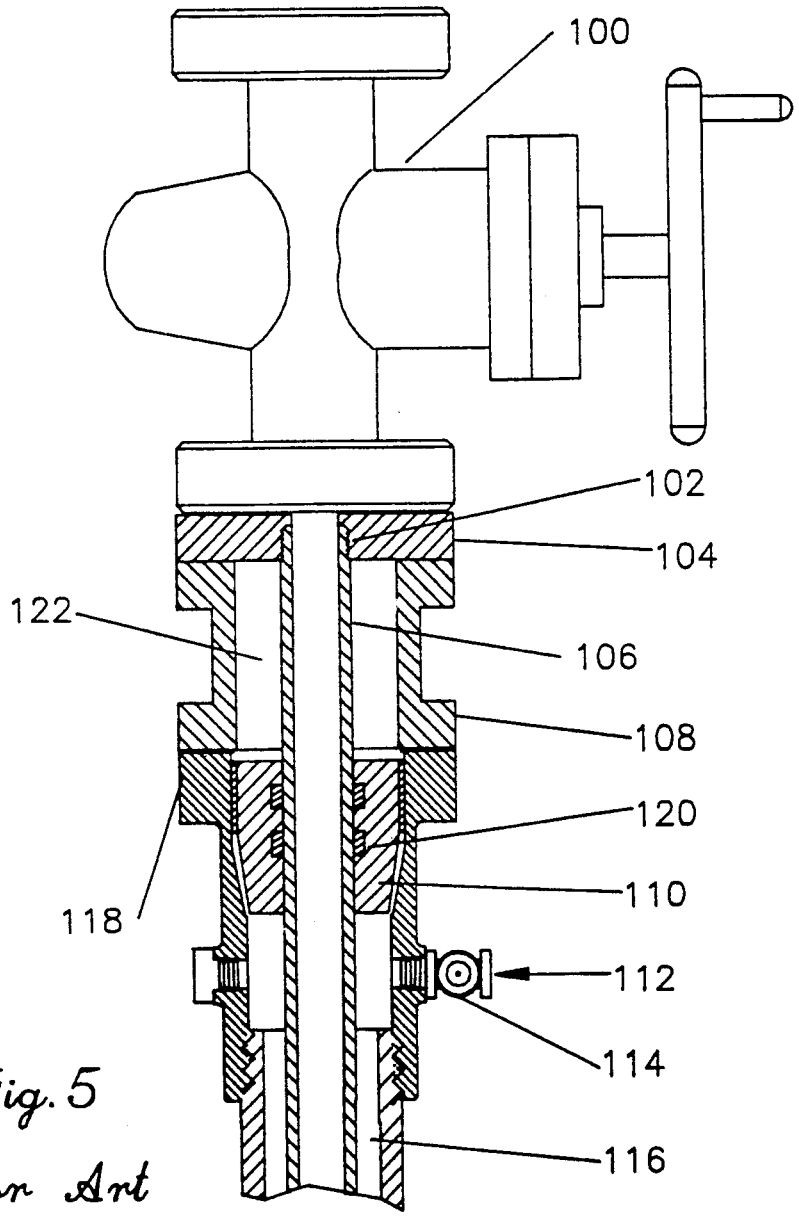
Fig. 5 Prior Art
FIG. 5 is a partial cross section schematic of an unsafe prior art method of mounting a high pressure valve on a low pressure casing head.

FIG. 5 shows an unsafe practice presently being used in the oilfield service industry. For purposes of pumping a high pressure fluid through a low pressure rated fitting or set of fittings and into the well tubing, a high pressure valve 100 is attached to a top flange 104, and this top flange threadingly attached to the well tubing 106 at 102. The top flange is also attached to a crossover spool 108, which crossover spool is attached to the casing head 118. The crossover spool is required to match the bolt patterns of the high pressure valve and the casing head. The tubing passes sealingly through the wraparound dognut 110, which dognut is also sealed in the casing head by seals 120. The cavity 122 is noted in the crossover spool. In some circumstances, a fluid 112 is pumped through the valve 114 and into the annulus 116 which extends down the well. This fluid is kept under pressure and raises the amount of pressure that can be held inside the tubing. This practice is known as pressurizing the annulus. There are two dangers when using this system. First, if there is a leakage in the thread between the top flange and the tubing at the threaded joint, it will allow an undetected pressure rise in the cavity noted. This cavity is sealed by the dognut and the high pressure would act on the low pressure rated casing head and damage it. The second danger shows itself when high pressure fluid is being pumped through the tubing when the well annulus is pressurized. This annulus pressurizing has an effect only on the tubing in the well and not on that enclosed by the crossover spool. This portion of the tubing thus becomes overpressured and is in danger of damage.

Figure 6:
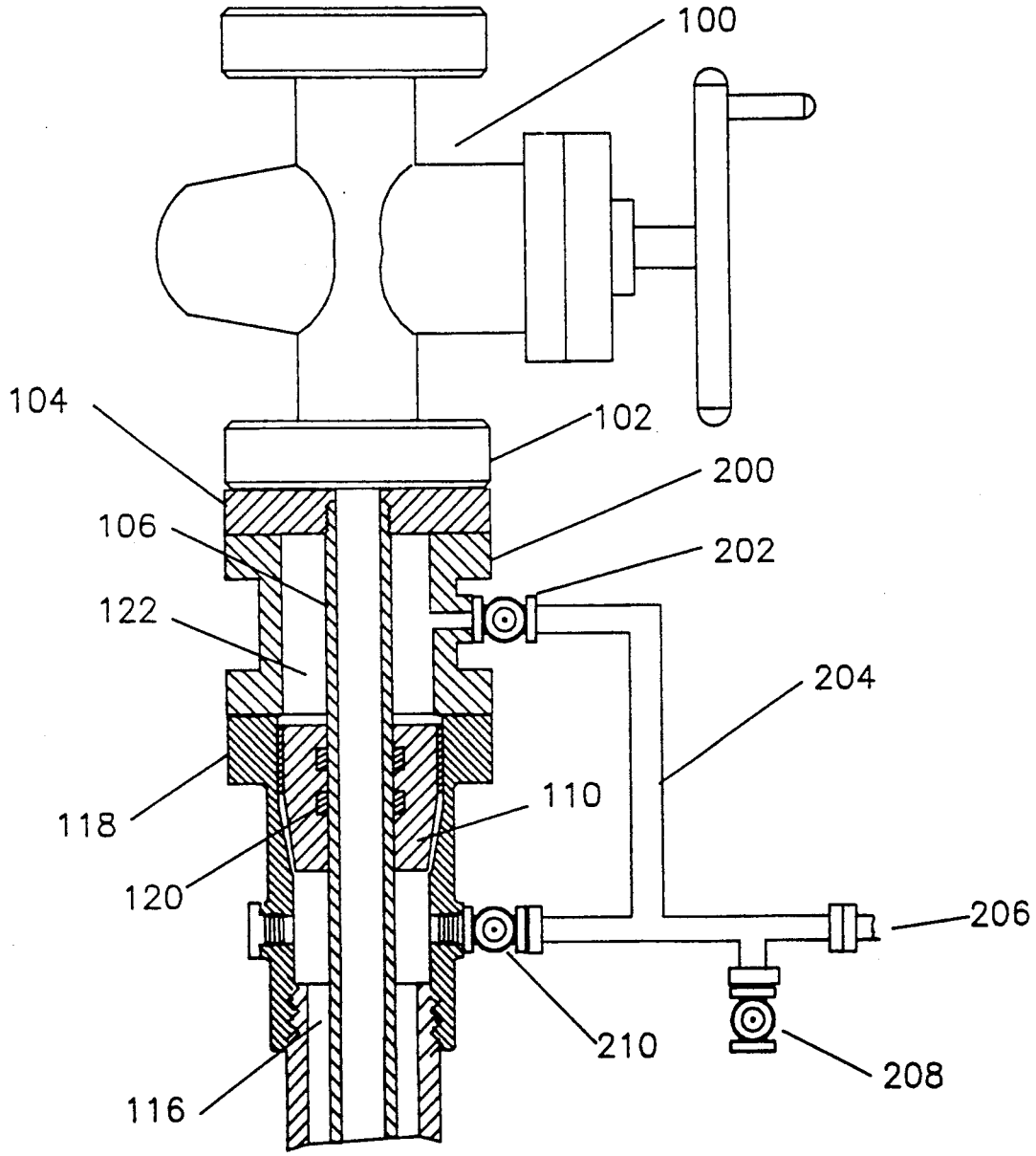
FIG. 6 is a partial cross section schematic of the proposed method of safely mounting a high pressure valve on a low pressure casing head.

As shown in FIG. 6, both of the noted dangerous situations are alleviated by use of the vented crossover spool or tubing head adapter 200 and its venting valve 202. In the case where there is no pressurizing of the annulus, the venting valve is left open to atmosphere and if there is any leakage, it will be noted and the pumping procedure stopped without pressuring up on the casing head. In the case where the annulus is being pressurized by fluid from an outside source 206, the manifold 204 connects the annulus pressure to the cavity surrounding the tubing in the vented crossover spool and thus holds pressure on this length of tubing and upgrades its pressure rating to that of the tubing in the well. If there happens to be leakage through the threads at the connection of the tubing to the top flange, this will cause a pressure rise in the cavity, manifold and annulus which will be vented to atmosphere through the pressure regulating valve 208. Pumping may be terminated if this happens and appropriate measures taken.

ALTERNATIVE EMBODIMENTS

A person skilled in the art could make immaterial modifications to the invention described and claimed in this patent without departing from the essence of the invention.

It will be appreciated that the hanger means referred to in the claims includes the tubing hanger 5 and the threaded portion of the adapter flange 104 or the equivalent means for hanging the tubing. Also, the sealing means may be any of various combinations of seals such as the packing rings in the grooves 17 and the seals 120 in the dognut. The venting means may be a port such as the vent port 20 or the venting valve 202 or the equivalent, the object being to provide a vented fitting between the casing head and the tubing head adapter.

We claim:

1. A high pressure adapter for a wellhead for use with a high pressure valve, the high pressure valve having a bore, and in which the wellhead includes a casing head, tubing and casing, the casing being suspended from the casing head and the tubing being disposed within the casing to form an annulus between the casing and the tubing, the high pressure adapter comprising:

hanger means for suspending the tubing within the casing;

a tubing head adapter disposed between the casing head and the high pressure vale, and defining a cavity, the tubing having a portion extending into the cavity;

sealing means disposed against the tubing above and below the cavity for sealing the bore of the high pressure valve from the cavity and for sealing the cavity from the annulus between the casing and the tubing; and venting means for venting the cavity to atmospheric pressure.

2. The high pressure adapter of claim 1 in which the venting means is a port in the tubing head adapter for venting the cavity.

3. The high pressure adapter of claim 1 in which the hanger means includes a tubing hanger supported by the casing head, and the sealing means includes a pack-off nipple connected to the tubing hanger, the pack-off nipple being disposed within and sealed against the tubing head adapter.

4. The high pressure adapter of claim 1 further including a cross-over spool disposed between the casing head and the tubing head adapter, and the venting means is a port in the cross-over spool.

5. The high pressure adapter of claim 1 in which the hanger means includes a flange disposed between the high pressure valve and the tubing head adapter, the tubing being suspended from and connected to the flange, and the sealing means includes the flange connection to the tubing and a wrap-around dognut supported by the casing head and sealed against the casing head.

6. The high pressure adapter of claim 5 in which the tubing head adapter is a cross-over spool disposed between the casing head and the flange.

7. The high pressure adapter of claim 5 further including aport for venting the annulus.

8. The high pressure adapter of claim 1 further including an adapter flange disposed between the tubing head adapter and the well-head.

9. The high pressure adapter of claim 8 in which the venting means is a port in the tubing head adapter for venting the cavity.

10. The high pressure adapter of claim 8 in which the hanger means includes a tubing hanger supported by the casing head, and the sealing means includes a pack-off nipple connected to the tubing hanger, the pack-off nipple being disposed within and sealed against the tubing head adapter.

* * * * *